US007044329B2

(12) United States Patent
Lum et al.

(10) Patent No.: US 7,044,329 B2
(45) Date of Patent: May 16, 2006

(54) CONTAINER FOR STORING AND DISPENSING BAGS

(75) Inventors: Myk Wayne Lum, Irvine, CA (US); Joseph Sandor, Santa Ana Heights, CA (US); Frank Yang, Palos Verdes Peninsula, CA (US)

(73) Assignee: Simplehuamn LLC, Torrance, CA (US)

( * ) Notice: Subject to any disclaimer, the term of this patent is extended or adjusted under 35 U.S.C. 154(b) by 184 days.

(21) Appl. No.: 10/623,998

(22) Filed: Jul. 21, 2003

(65) Prior Publication Data

US 2005/0016230 A1 Jan. 27, 2005

(51) Int. Cl.
*A47K 10/24* (2006.01)

(52) U.S. Cl. ..... 221/45; 206/554

(58) Field of Classification Search ..... 221/33, 221/45, 63, 48, 303; 206/554, 494, 449, 206/812

See application file for complete search history.

(56) References Cited

U.S. PATENT DOCUMENTS

| | | | | |
|---|---|---|---|---|
| 4,537,330 | A | 8/1985 | Gelbard | |
| 4,574,981 | A | 3/1986 | Jewett | |
| 4,623,073 | A | 11/1986 | Hansen | |
| 5,002,200 | A | 3/1991 | Hunt | |
| 5,042,687 | A | 8/1991 | McKinley | |
| D329,344 | S | 9/1992 | Carillo | |
| 5,211,308 | A * | 5/1993 | Decker et al. | 221/63 |
| 5,285,927 | A | 2/1994 | Pruitt | |
| D358,325 | S | 5/1995 | McNaughton | |
| 5,511,691 | A | 4/1996 | West, Jr. | |
| 5,794,815 | A * | 8/1998 | Carlson et al. | 221/45 |
| D397,566 | S | 9/1998 | Choiniere et al. | |
| D419,010 | S | 1/2000 | Hansen et al. | |
| 6,401,971 | B1 | 6/2002 | Edwards et al. | |
| D475,873 | S | 6/2003 | Mello | |
| 2002/0145004 | A1 | 10/2002 | Bennett et al. | |
| 2003/0168378 | A1 * | 9/2003 | Au | 206/736 |
| 2005/0056656 | A1 * | 3/2005 | Hochtritt et al. | 221/45 |

* cited by examiner

*Primary Examiner*—Kenneth Noland
(74) *Attorney, Agent, or Firm*—Liu & Liu

(57) ABSTRACT

A container for storing and dispensing plastic bags and process for manufacturing the same. The container includes a front panel extending from the top of the container to the bottom of the container and having a substantially smooth surface with no sharp bents. The container includes a funnel-shaped aperture for facilitating insertion of the plastic bags into the container in a compact and collapsed form. The container has a flat profile that allows the container to be mounted to a vertical surface in a space-saving manner and that helps minimize entanglement as more bags are inserted into the container. The container also includes an access opening for dispensing the plastic bags.

27 Claims, 7 Drawing Sheets

208
207
70
209

209
207
60
208

110
209
209

120
150
153

CONTAINER FOR STORING AND DISPENSING BAGS

FIELD OF THE INVENTION

The present invention relates to a container for storing and dispensing bags, and more particularly to plastic bags.

BACKGROUND OF THE INVENTION

Plastic bags are commonly used to package various types of consumer goods, such as food and related products, for ease in transporting the goods. Consumers then often save their plastic bags for reuse as trash bags, for example. However, storage of used plastic bags is often cumbersome. Also, it is difficult to maintain plastic bags in a compact form due to its resilient nature. As such, used plastic bags require more storage space than paper bags.

Containers have been developed to facilitate storage of used plastic bags. U.S. Pat. No. 5,002,200 to Hunt discloses a container for used plastic bags. The container is not aesthetically appealing and occupies a relatively larger footprint for a given container volume due to its cuboid configuration. The larger footprint competes for scarce storage space in a storage cabinet, for example. The container includes a small opening at the top of the container for access and dispensing of the bags. As such, before a bag can be placed into the container for storage, the user must manipulate the bag into a compact form to fit through the small opening. This can be cumbersome and difficult for some users. When the container is relatively empty, as bags are inserted into the container, they tend to expand to fill the container, and subsequently inserted bags tend to entangle with each other. As a result, when a user pulls to remove a bag from the container, more than one bag may be dispensed.

It is therefore desirable to have a container that is of a compact space-saving profile, that is aesthetically appealing, as well as efficient with respect to storage space.

SUMMARY OF THE INVENTION

The present invention is directed to a container for storing and dispensing various types of plastic bags. In one aspect of the present invention, the container is configured to facilitate storage of the plastic bags in an organized fashion and to minimize entanglement of the plastic bags with each other. In one embodiment, the container includes a funnel-shaped aperture. The wider end of the aperture confronts the outer side of the container, and the narrower end is disposed within the container. The funnel-shaped aperture facilitates collapsing the plastic bags into a compact form for insertion of the plastic bags into the container. In some embodiments, the container is configured having a flat profile. As more bags are inserted into the container, the flat profile of the container facilitates stacking the bags in their collapsed form. As such, entanglement of the bags is minimized. In certain embodiments, the container includes means for mounting the container to a vertical surface, such as underneath or inside a cabinet. The flat profile of the container also minimizes the space occupied by the container when mounted underneath the cabinet, for instance.

In another aspect of the invention, the container includes a substantially smooth front panel extending from the top of the container to the bottom of the container. In some embodiments, the front panel of the container has no sharp bents. In certain embodiments, the front panel is made from a sheet of metal.

In a further aspect of the present invention, the container includes a metal front panel, extending from the top of the container to the bottom of the container and having an access opening at the top, and a protective guard for the access opening.

The container can include components made from either metal or plastic. In still a further aspect of the invention, the container includes means for mounting the metallic components to the plastic components. In one embodiment, the container includes a metal front panel, a rear plastic base, and a mounting member. The mounting member provides a support structure for fasteners to attach the metal front panel to the plastic base.

In still a further aspect of the invention, the components of the container are designed for improved manufacturability. In some embodiments, the container includes a one-piece rear and side panel whereby the side-panels are foldable with respect to the rear panel. The one-piece rear and side panel is made from a plastic. At the junctions of the rear and side panels, the plastic material is thinner and/or scored, which allows the side panels to hingedly fold with respect to the rear panel.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF THE PREFERRED EMBODIMENTS

This invention is described below in reference to various embodiments with reference to the figures. While this invention is described in terms of the best mode for achieving this invention's objectives, it will be appreciated by those skilled in the art that variations may be accomplished in view of these teachings without deviating from the spirit or scope of the invention.

The present invention is directed to a container for storing and dispensing various types of bags. The container is particularly suited for storing and dispensing plastic bags, including, but not limited to, new or used bags made from polyethylene, such as those used in the grocery industry for packaging products for ease in carrying. For purposes of illustrating the principles of the present invention and not by limitation, the present invention is described by reference to embodiments directed to a container for storing and dispensing used plastic bags.

Figure 1:
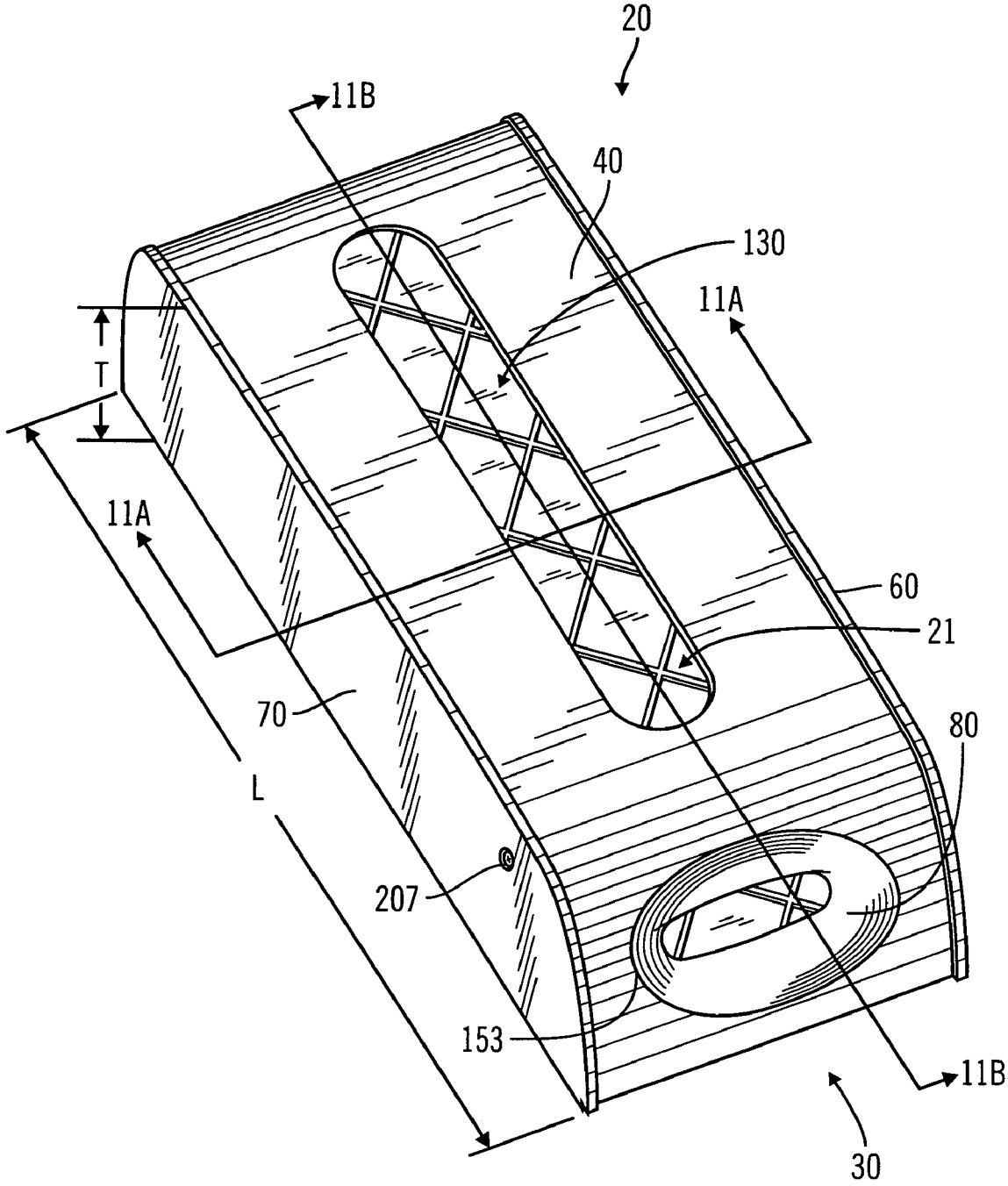
FIG. 1 is a perspective view of a container for storing and dispensing plastic bags in accordance with one embodiment of the present invention.
Figure 4:
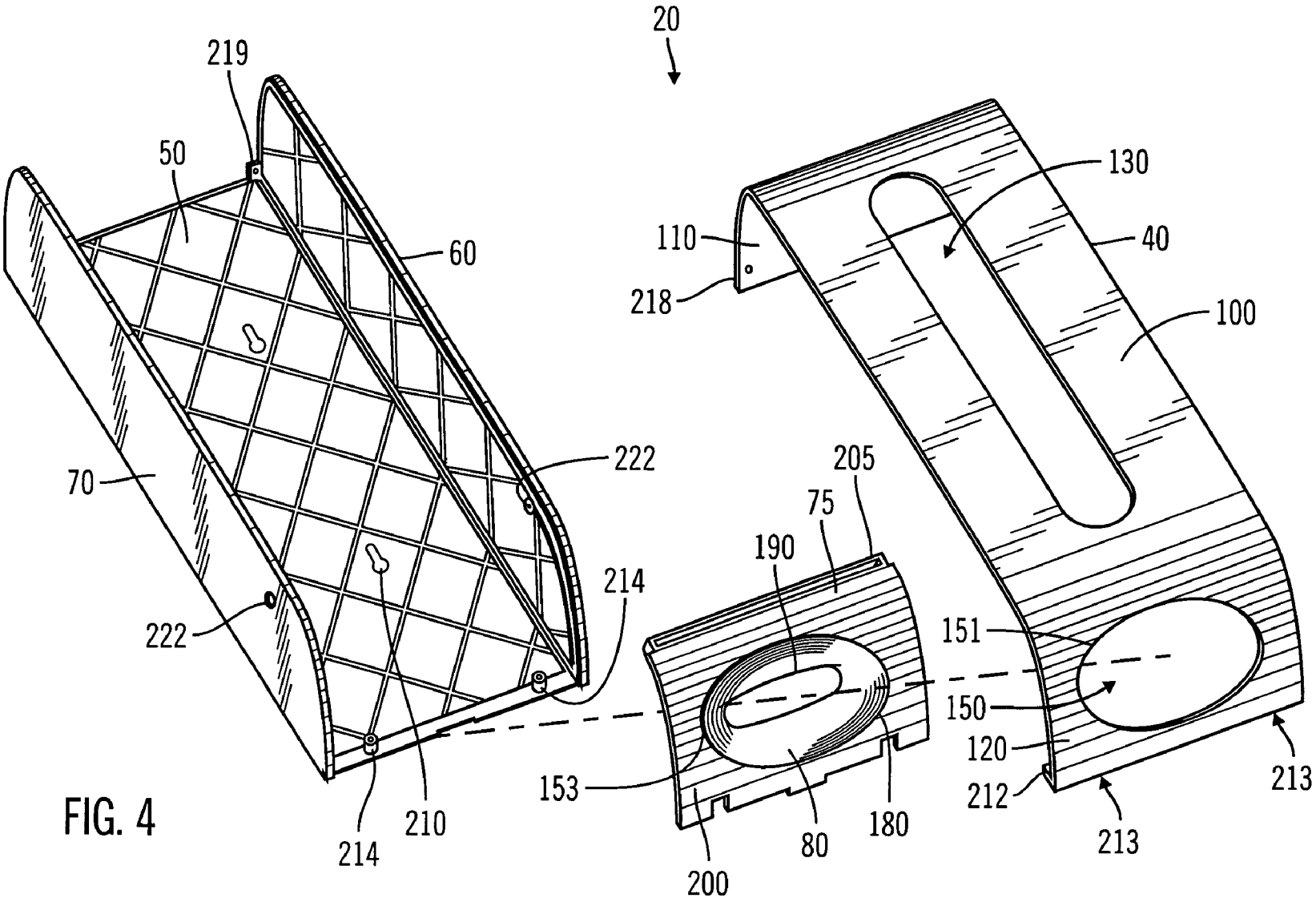
FIG. 4 is an exploded view of the container shown in FIG. 1.

FIG. 1 is a perspective view of a container 20 for storing and dispensing plastic bags in accordance with one embodiment of the present invention. The container 20 provides a housing for storing the plastic bags. Arrow 30 shows the orientation of the container 20 from top to bottom when the container 20 is mounted against a vertical surface. FIG. 4 is an exploded view of the container 20 shown in FIG. 1. The container 20 includes a front panel 40, a rear panel or base 50, two identical side panels 60 and 70, and a bracket 75 having a funnel-shaped aperture 80. The container 20 defines a storage space 21.

Figure 5:
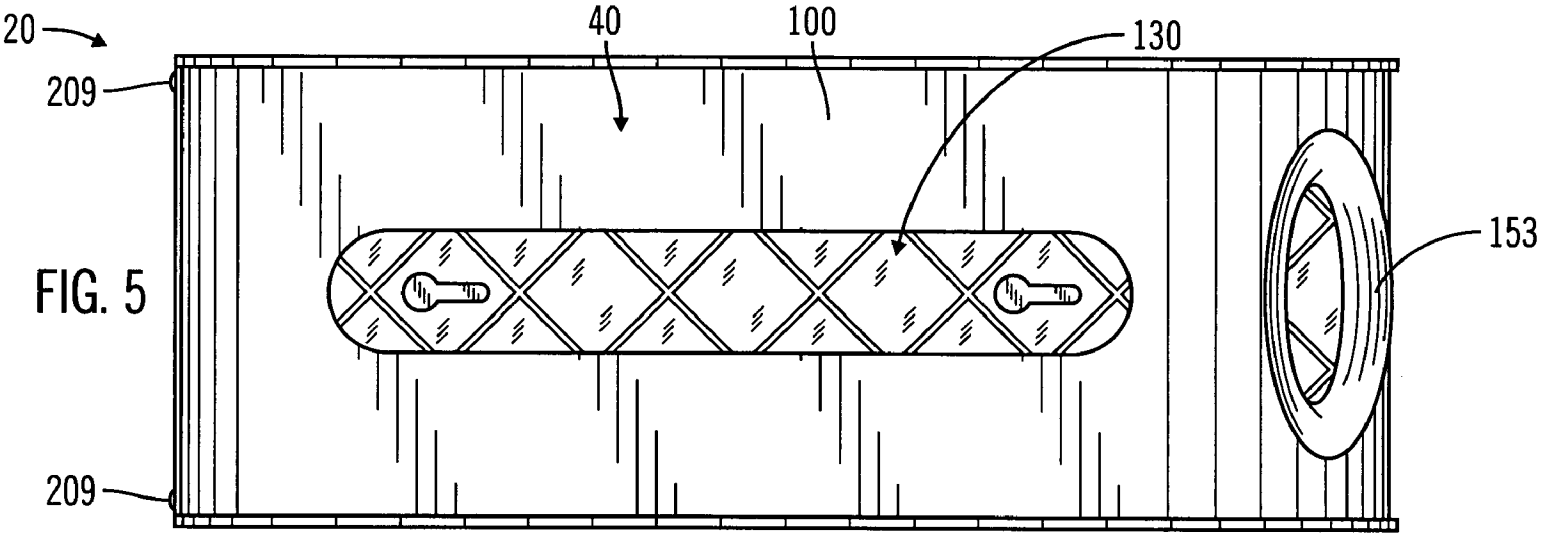
FIG. 5 is a front view of the container shown in FIG. 1.

Referring to FIG. 4, the front panel 40 extends from top of the container 20 to the bottom of the container 20. The front panel 40 includes three sections: a middle section 100, a first end section 110 and a second end section 120. The middle section 100 of the front panel 40 defines the front or forward side of the container 20. FIG. 5, which is a front view of the container 20, shows the middle section 100 of the front panel 40. The middle section 100 has an opening 130 sized and shaped to facilitate accessing and dispensing the plastic bags housed within the container 20. The opening 130 has an elongated shape, e.g., an elongated oval shape.

Figures 7, 8, 9, 10:
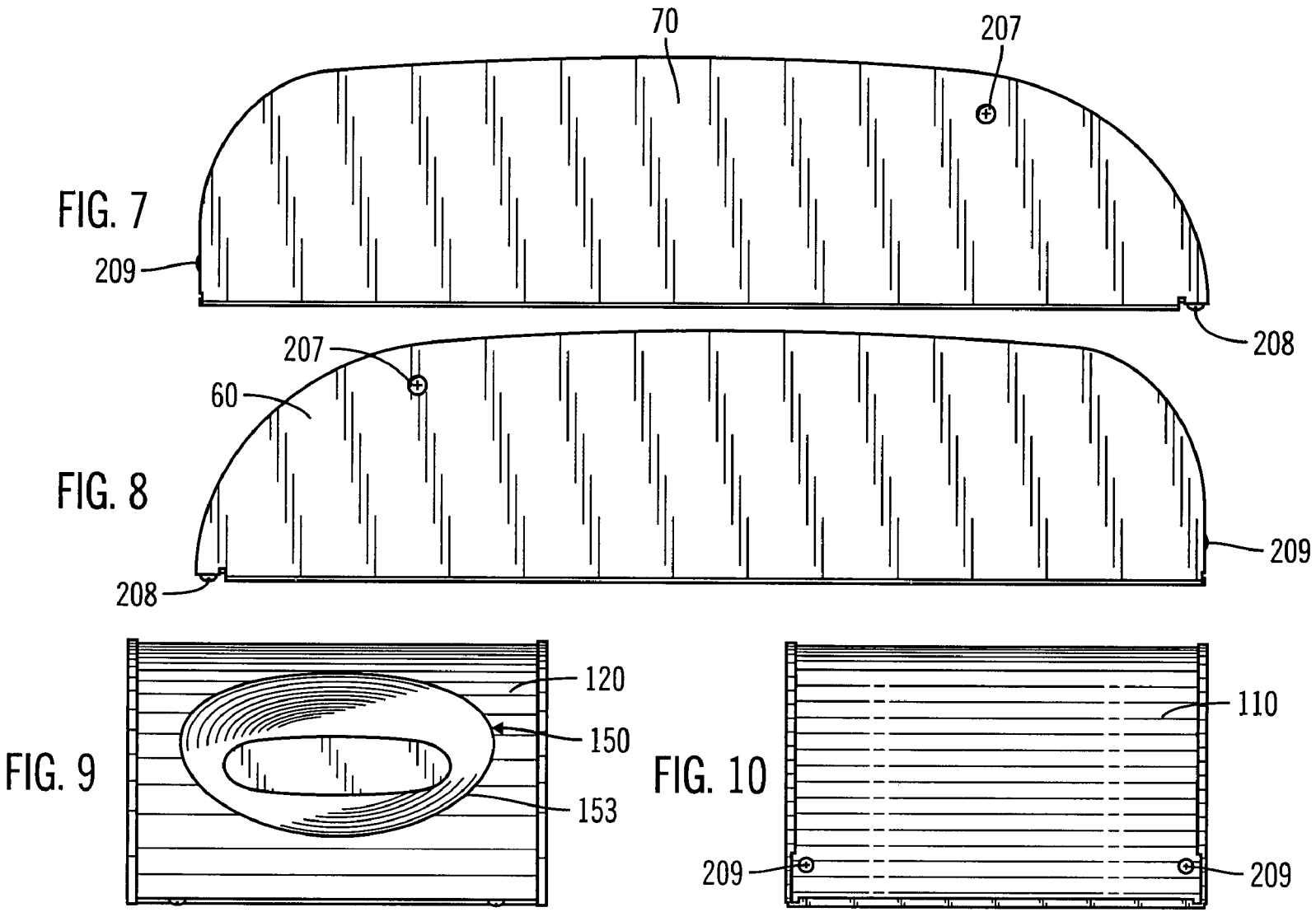
FIGS. 7 and 8 are side views of the container shown in FIG. 1.
FIG. 9 is a top view of the container shown in FIG. 1.
FIG. 10 is a bottom view of the container shown in FIG. 1.

Referring back to FIG. 4, the first end section 110 is oriented substantially perpendicular to the middle section 100 and defines the bottom side of the container 20. FIG. 10 is a bottom view of the container 20 shown in FIG. 1, which more clearly shows the first end section 110 of the front panel 40. The first end section 110 is bent with respect to the middle section 100 such that bottom bend 140 is substantially smooth.

Referring back to FIG. 4, the second end section 120 has a substantially smooth curved shape and defines the top side of the container 20. The second end section 120 has an opening 150 sized and shaped to facilitate insertion of plastic bags into the container 20. FIG. 9 is a top view of the container 20 showing the second end section 120 of the front panel 40. A protective guard 153 can be included at the opening 150 to provide a safety measure against sharp edges that can cut a user's finger or hands.

The front panel 40 can be made from a smooth sheet of metal, such as stainless steel, which provides the container with substantial rigidity and aesthetic appeal. Alternatively, the front panel 40 can be made from a rigid plastic material or a pliable plastic that can be bent to form a relatively rigid structure of the middle and end sections.

Figure 2:
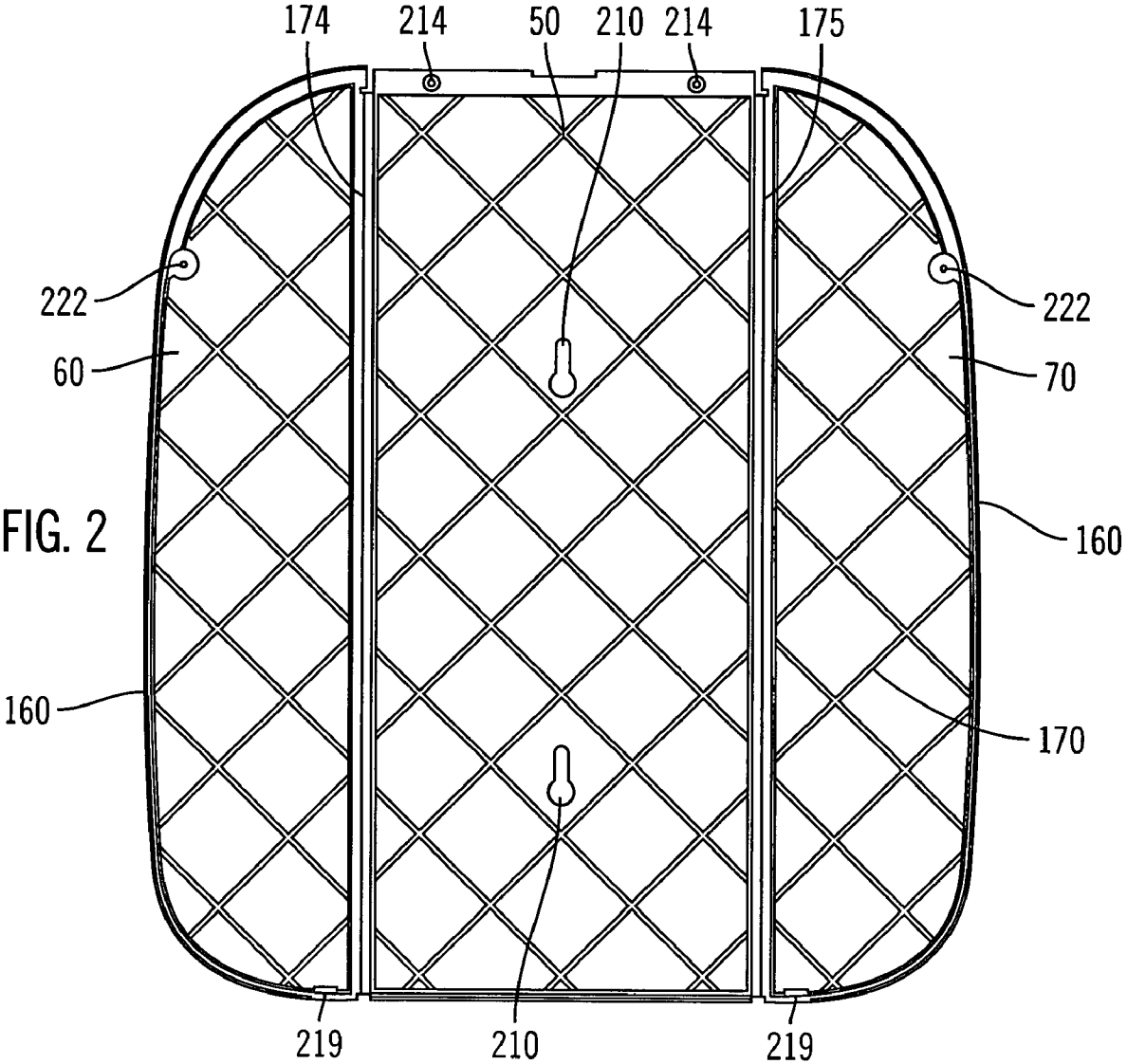
FIG. 2 is a schematic view of inner surfaces of a rear panel and side panels of the container shown in FIG. 1.
Figure 3:
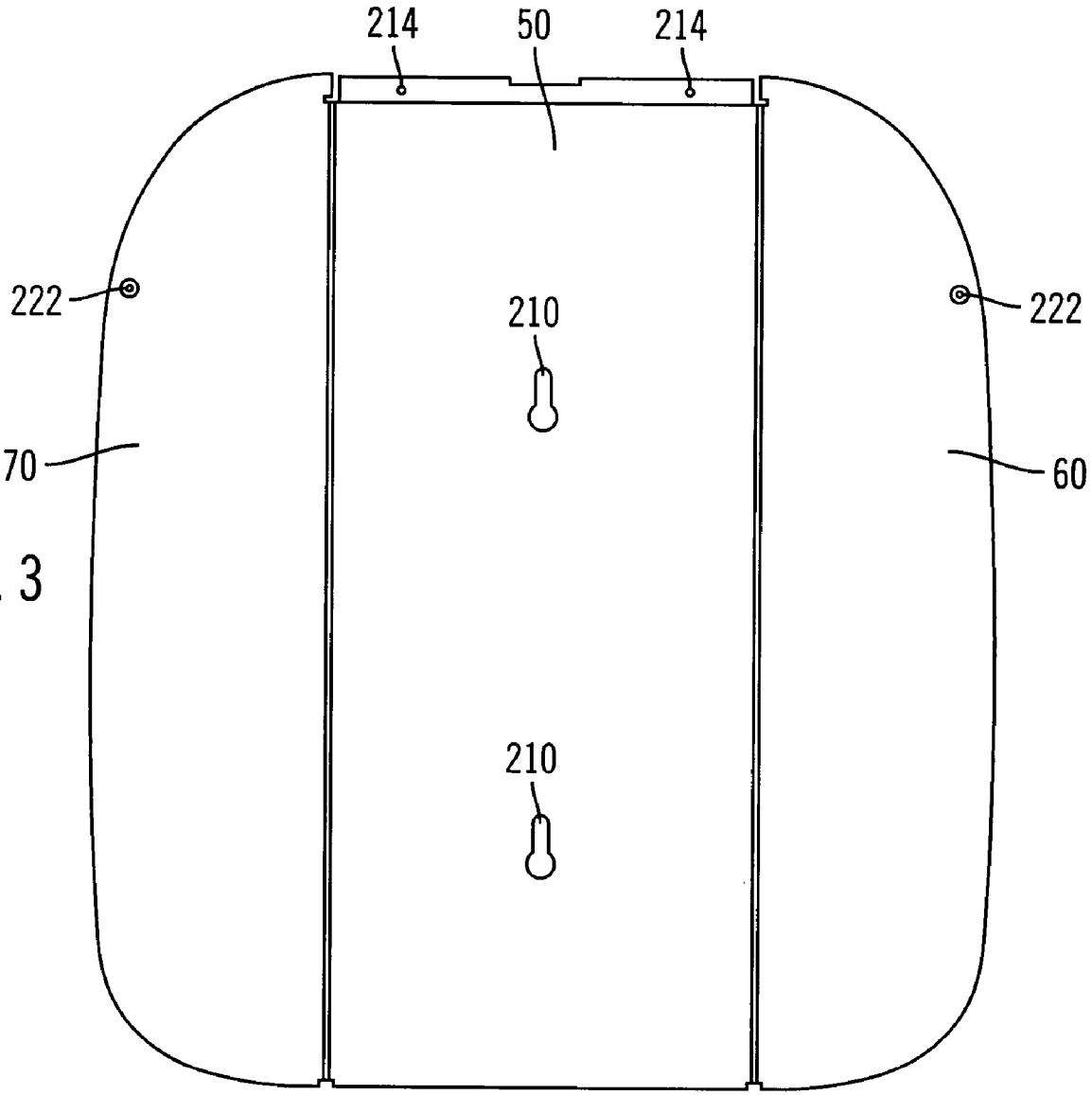
FIG. 3 is a schematic view of outer surfaces of the rear panel and the side panels of the container shown in FIG. 1.
Figure 11A:
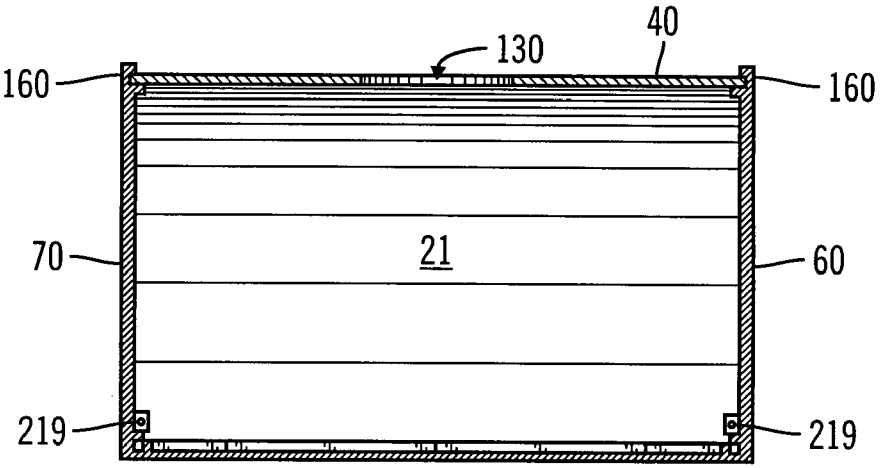
FIG. 11A is a sectional view of the container shown in FIG. 1, taken along line 11A—11A.
Figure 11B:
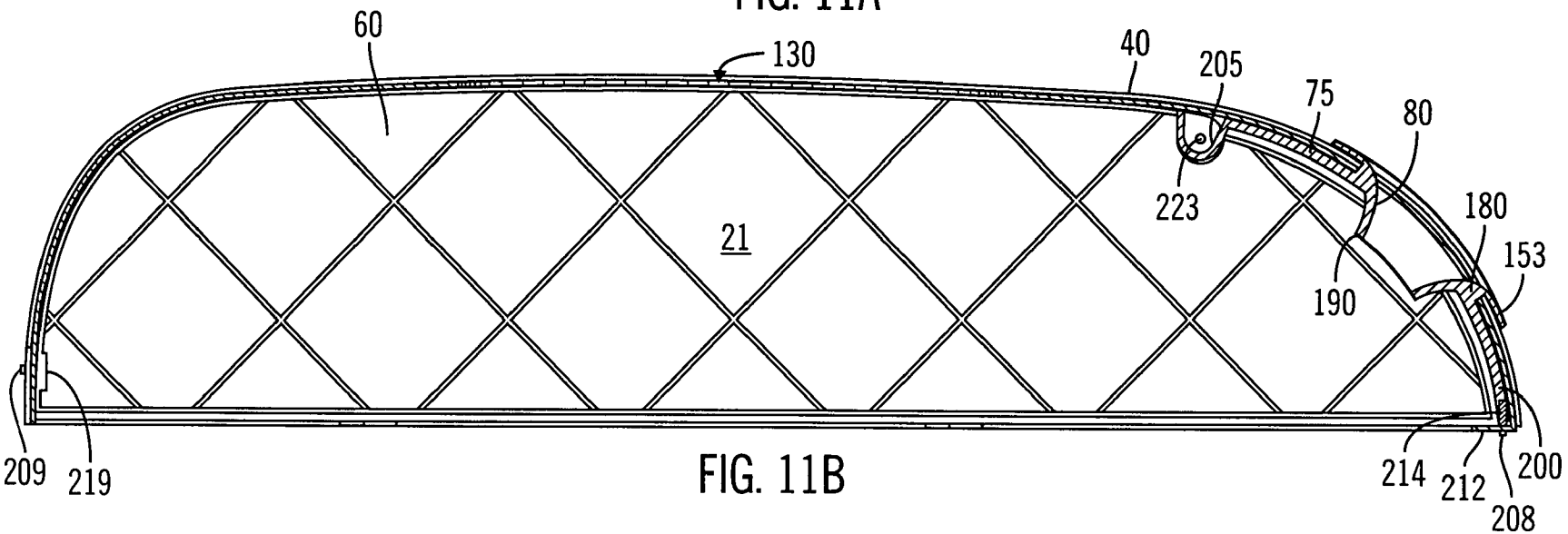
FIG. 11B is a sectional view of the container shown in FIG. 1, taken along line 11B—11B.

Referring to FIG. 4, the side panels 60 and 70 are attached to the rear panel or base 50 such that the side panels 60 and 70 are oriented substantially perpendicular with respect to the rear panel 50. The rear panel 50 and the side panels 60 and 70 can be provided as a monolithic or a one-piece structure, with the side panels 60 and 70 hingedly attached to the bottom panel 50. FIG. 2 is a schematic view of the inner surfaces of the one-piece rear and side panels 50, 60 and 70. FIG. 3 is a schematic view of the outer surfaces of the rear and side panels 50, 60 and 70. FIGS. 7 and 8 are side views of the container 20 showing the side panels 70 and 60, respectively. The one-piece structure can be made from a rigid material (e.g., plastic) that provides sufficient rigidity for supporting the front panel 40 and for housing the plastic bags. As shown in FIG. 2, the inner surfaces of the rear and side panels 50, 60 and 70 can also be provided with ribs 170 for providing additional rigidity to the container 40. At junctions 174 and 175 of the rear and side panels 50, 60 and 70, the plastic material has a reduced thickness and/or is scored so that the side panels 60 and 70 can hingedly fold with respect to the rear panel 50. The side panels 60 and 70 can be folded from a flat position as shown in FIGS. 2 and 3 to an upright position as shown in FIGS. 1 and 4. The side panels 60 and 70 include grooves 160 extending along the periphery of the side panels 60 and 70. Depending upon the particular requirements of the application, the grooves 160 can extend along substantially the entire periphery or only portions of the periphery. The grooves 160 are adapted to receive side edges of the front panel 40, facilitating attaching the front panel 40 to the side panels 60 and 70. FIGS. 11A and 11B are sectional views of the container 20 taken along lines 11A—11A and 11B—11B respectively. FIGS. 11A and 11B show the front panel 40 assembled to the side panels 60 and 70 within the grooves 160. Alternatively, the rear panel 50 and the side panels 60 and 70 can be provided as separate structures that can be attached together by fastening means well known in the art. Also, the panels 50, 60 and 70 can be made from a sheet of metal, such as stainless steel.

Referring to FIGS. 4 and 11B, the bracket 75 has an aperture 80 that facilitates insertion of plastic bags into the container 20. The aperture 80 has a funnel shape having a wide end 180 facing the outside of the container 20, and a narrow end 190 facing the storage space 21. The bracket 75 includes support structure 200 for positioning the aperture 80 in alignment with the opening 150. The bracket 75 is disposed at about the second end section 120 of the front panel 40. As a bag passes from the wide end 180 of the aperture 80 through the narrow end 190 and into the storage space 21 of the container 20, the aperture 80 manipulates and collapses the bag into a compact form. As such, the plastic bags can be more efficiently stored within the container 20, allowing more plastic bags to fit within the storage space 21. It is understood that the aperture 80 can have other shapes that facilitate collapsing the plastic bags into a compact form. In an alternative embodiment (not shown), the front panel is provided with a funnel-shaped opening in place of the opening 150.

The bracket 75 also provides a mounting structure for the metal front panel 40 and the plastic side panels 60 and 70 comprising a mounting member 205. The mounting member is adapted to receive fasteners, such as screws 207. The side panels 60 and 70 include through holes 222 aligned with screw holes 223 of the mounting member 205. The screws 207 attach the plastic side panels 60 and 70 to the mounting member 205. Alternatively, the side panels can be attached to the mounting member by other fastening means such as an adhesive material. Once attached to the mounting member 205, the side panels 60 and 70 clamp the side edges of the metal front panel 40 within the grooves 160. The side panels clamp the front panel in place with respect to the side panels. The mounting member 205 allows for mounting the plastic components (i.e., the side panels 60 and 70) of the container to the metal components (i.e., the front panel 40). As such, no external bent mounting tabs are required to attach the front panel 40 to the side panels 60 and 70, which improves the aesthetic quality of the container 20 (i.e., no unsightly tabs). In alternate embodiments (not shown), the mounting member is provided as a structure separate from the bracket.

Figure 6:
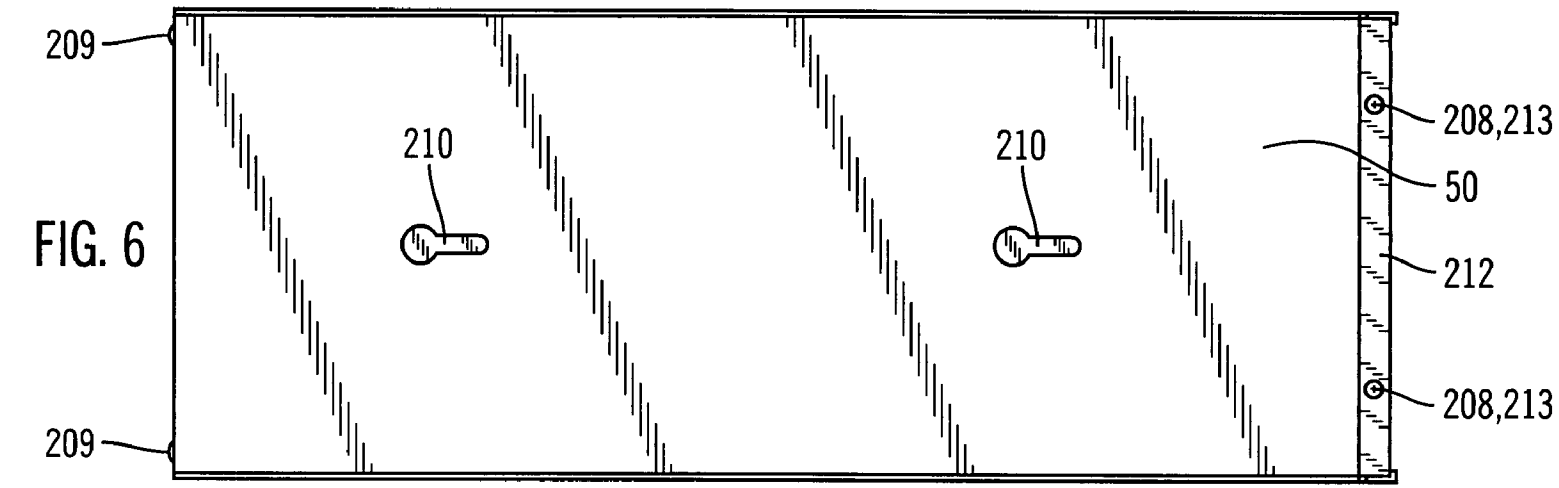
FIG. 6 is a rear view of the container shown in FIG. 1.

The container 20 includes means well known in the art for mounting the container 20 to a wall. FIG. 6 is a rear view of the container 20 shown in FIG. 1. The rear panel 50 is provided with slots 210 that are adapted to engage a hook, nail, screw, or other similar structures that is secured to the wall. The slots 210 allow the container to be mounted underneath a cabinet for example.

Referring back to FIG. 1, the container 20 has a length L and a thickness T. The container 20 has a relatively long length L with respect to its thickness T, giving the container 20 a relatively flat profile. When the container 20 is mounted in an area of limited space, such as underneath or inside a cabinet, the relatively flat profile of the container 20 allows the container 20 to occupy relatively less lateral space. Additionally, the flat profile of the container 20 facilitates storing the plastic bags in a stacked and organized fashion. As more plastic bags are inserted at the top opening 150 and through the aperture 80 into the container 20, the bags pass though the small thickness T of the container 20 on their way down to the bottom of the container 20. The small thickness T of the container 20 guides and channels the bags in an organized fashion so that the bags stack on top of each other in a collapsed form. As such, the flat profile of the container 20 helps minimize entanglement of the bags with each other.

The present invention is also embodied in a process for assembling the container 20 shown in FIG. 1. A step in the process is folding the side panels 60 and 70, along the scored junctions 174 and 175, from their flat positions to their upright positions. A further step is positioning the front panel 40 with respect to the side panels 60 and 70 such that the side edges of the front panel 40 are fitted within the grooves 160 of the side panels 60 and 70. The bracket 75 is positioned at the opening 150 of the front panel 40 such that the wide end 180 of the funnel-shaped aperture 80 faces the outside of the container 20 and the narrow end 190 faces the storage space 21. Yet a further step is clamping the side edges of the front panel 40 within the grooves 160 of the side panels 60 and 70. Clamping the front panel 40 involves attaching the side panels 60 and 70 to the mounting member 205 by one or more fasteners, such as the screws 207. When the side panels 60 and 70 are attached to the mounting member 205, the side panels 60 and 70 clamp the side edges of the front panel 40 so to maintain the side edges of the front panel 40 within the grooves 160 of the side panels 60 and 70. Additionally, the first and second end sections 110 and 120 of the front panel 40 can be fastened to the rear and side panels 50, 60 and 70 by one or more fasteners, such as screws 208 and 209. At the first end section 110 of the front panel 40 is a bent tab 212 having holes 213 aligned with cylindrical stubs 214 having holes for allowing the front panel 40 to be fastened to the rear panel 50 by the screws 208. The second end section 120 of the front panel 40 also includes holes 218 aligned with tabs 219 having holes for allowing the front panel 40 to be fastened to the side panels 60 and 70 by the screws 209.

In operation, the user inserts bags into the container 20 via the funnel-shaped aperture 80. As the bags pass from the wider end 180 of the aperture 80 through the narrower end 190, the funnel shape of the aperture 80 manipulates and collapses the bags into a compact form that allows the bags to fit compactly within the container 20. The user is not required to first manipulate the bags into a compact form before insertion into the container 20. Also, the flat profile of the container 20 aids in stacking the bags in an organized fashion so that there is minimal entanglement of the bags with each other. The user can dispense bags from within the container 20 by accessing the bags from the front access opening 130 at the front panel 40. The bags can be selectively dispensed from the container 20 since the bags are stored in a stacked and organized fashion.

While the invention has been particularly shown and described with reference to the preferred embodiments, it will be understood by those skilled in the art that various changes in form and detail may be made without departing from the spirit, scope, and teaching of the invention. A person skilled in the art will recognize that the instrument incorporating the essence of this invention can also be used for storage of other types of collapsible items made from plastic. Accordingly, the disclosed invention is to be considered merely as illustrative and limited in scope only as specified in the appended claims.

We claim:

1. A dispenser of plastic bags, comprising:

a substantially smooth front panel defining a top, bottom and middles sections of the dispenser, wherein the front panel includes an access opening for accessing the plastic bags and a funnel-shaped aperture extending into the dispenser; and a rear portion coupled to the front panel to form a housing of the dispenser.

2. The dispenser of claim 1, wherein the front panel includes substantially rounded corners.

3. The dispenser of claim 1, wherein the front panel includes no sharp bents.

4. The dispenser of claim 1, wherein the front panel is made from a sheet of metal.

5. The dispenser of claim 1, wherein the front panel comprises a protective guard defining the funnel shaped aperture.

6. A container for storing and dispensing plastic bags, comprising:

a housing having at least one aperture for plastic bags, the housing comprising:

a front panel made from a metal;

side panels made from a plastic material; and a separate mounting member extending between the side panels for facilitating assembling the metal front panel to the plastic side panels.

7. The container of claim 6, wherein the mounting member is adapted to receive a fastener for attaching the side panels to the mounting member.

8. The container of claim 7, wherein the fastener is a screw.

9. The container of claim 7, wherein the mounting member includes a funnel shaped structure defining the aperture.

10. The container of claim 7, wherein the fastener is an adhesive material.

11. The container of claim 7, wherein when the side panels are attached to the mounting member, the side panels clamp the front panel in place with respect to the side panels without fastening the front panel to the side panels.

12. The container of claim 6, wherein the side panels include grooves extending along the periphery of the side panels, the grooves adapted to receive side edges of the front panel.

13. A container for storing and dispensing plastic bags, comprising:

a housing defining a storage space, an access opening, and a funnel-shaped aperture for insertion of the plastic bags into the container, wherein a wide end of the aperture faces the outside of the container and a narrow end faces the storage space.

14. The container of claim 13, further comprising a bracket having the funnel-shaped aperture.

15. The container of claim 14, further comprising a panel having an opening, wherein the bracket is positioned relative to the opening such that the wide end of the aperture faces the opening.

16. The container of claim 13, further comprising a panel having the funnel-shaped aperture.

17. A container for storing and dispensing plastic bags, comprising:

a front panel having an access opening;

a rear portion comprising a one-piece panel having a rear panel and side panels, wherein the side panels are foldable relative to the rear panel wherein the front panel is assembled to the one-piece panel to form a housing.

18. The container of claim 17, wherein the one-piece panel is made of a plastic material.

19. The container of claim 17, wherein the one-piece panel includes a scored section to facilitate folding the side panels relative to the rear panel.

20. The container of claim 17, wherein the side panels include grooves adapted to receive the front panel.

21. The container of claim 20, wherein the front panel has the aperture at the top section.

22. The container of claim 20, wherein the container has a flat profile such that as plastic bags are inserted through the aperture the bags are stacked in an organized fashion.

23. The container of claim 20, further comprising means for mounting the container to a vertical surface.

24. The process of claim 23, wherein the clamping step further comprises the steps:

providing a mounting member; and attaching the side panels to the mounting member such that the side panels clamp the front panel.

25. The process of claim 23, further comprising attaching the front panel to the rear panel.

26. The process of claim 23, further comprising attaching the front panel to the side panels.

27. A container for storing and dispensing plastic bags, comprising:

a front panel defining a top, bottom and middle sections, wherein the front panel having an opening for accessing the plastic bags and a protective guard defining a funnel-shaped aperture for inserting the plastic bags; and a rear portion coupled to the front panel to form a housing of the container.

* * * * *